US006366183B1

(12) United States Patent
Hendrick et al.

(10) Patent No.: US 6,366,183 B1
(45) Date of Patent: Apr. 2, 2002

(54) LOW PIM COAXIAL DIPLEXER INTERFACE

(75) Inventors: Louis W. Hendrick, Hermosa Beach; Robert L. Reynolds, Thousand Oaks; Rolf Kich, Redondo Beach, all of CA (US)

(73) Assignee: Hughes Electronics Corp., El Segundo, CA (US)

( * ) Notice: Subject to any disclaimer, the term of this patent is extended or adjusted under 35 U.S.C. 154(b) by 0 days.

(21) Appl. No.: 09/458,260

(22) Filed: Dec. 9, 1999

(51) Int. Cl.[7] ..... H01P 1/20; H01P 3/06; H01P 1/00

(52) U.S. Cl. ..... 333/202; 333/243; 333/245; 333/260

(58) Field of Search ..... 333/202, 243, 333/245, 260

(56) References Cited

U.S. PATENT DOCUMENTS

| | | | | |
|---|---|---|---|---|
| 3,289,117 A | | 11/1966 | Kearns et al. | |
| 5,280,292 A | * | 1/1994 | Tondryk | 333/109 |
| 5,471,177 A | * | 11/1995 | Hudspeth et al. | 333/126 |
| 5,668,565 A | * | 9/1997 | Robinson | 333/34 |
| 5,889,449 A | * | 3/1999 | Fiedziuszko | 333/239 |
| 6,046,702 A | * | 4/2000 | Curtis et al. | 333/135 |

FOREIGN PATENT DOCUMENTS

| | | |
|---|---|---|
| DE | AU-A-89600/98 | 10/1997 |
| DE | 0 913 878 A1 | 5/1999 |

OTHER PUBLICATIONS

Connor, G.G. "Elimination of Fine Tuning in High Power, Low–PIM Diplexers for Combined Transmit/Receive antennas" (1990) British Aerospace, pp. 1–6.

Khattab, et al. "Principles of Low PIM Hardware Design" (1996) The Electronic Engineering Laboratory, University of Kent, England, pp. 1–8.

Carlson, B. "RF/Microwave Connector Design for Low Intermodulation Generation" (1993) Interconnection Technology, pp. 1–5.

King, J. "Intermodulation in coaxial connectors"(1996) RF Tutorial, pp–1–3.

* cited by examiner

*Primary Examiner*—Robert Pascal
*Assistant Examiner*—Patricia T. Nguyen
(74) *Attorney, Agent, or Firm*—Terje Gudmestad

(57) ABSTRACT

A common interface (10) for a PIM sensitive diplexing filter (30) is provided in a non-contacting, or isolated, configuration while providing PIM reliability, ESD conduction and thermal conduction, making it ideal for high power space applications. The common interface (10) is a one-piece construction of a diplexed, or multiplexed, coaxial, or squareax, transmission line that is constructed with a direct non-contacting (34, 36), or connectionless, interface. Terminations (26, 28) connect the inner conductor (20) to the outer conductor (12) of the interface (10) making the device one integral piece yet providing the necessary isolation through non-contacting interface with a PIM sensitive device and terminations (26, 28) that provide thermal and ESD conduction necessary for PIM reliablity.

11 Claims, 1 Drawing Sheet

LOW PIM COAXIAL DIPLEXER INTERFACE

TECHNICAL FIELD

The present invention relates to a PIM sensitive diplexing or multiplexing filter and more particularly to an interface for the coaxial common port of a diplexing or multiplexing filter.

BACKGROUND ART

A common coaxial transmission line must be connected to the resonating elements of a filter section in such a manner as to reliably avoid the production of passive intermodulation (PIM) . The highest reliability in the avoidance of PIM is accomplished by coupling the transmission line and the filter in a non-contacting, or "isolated" configuration, i.e. a capacitive joint and/or an inductive joint. However, while this electrical isolation avoids PIM, it introduces other problems. For example, there is no bleed path for electrostatic charge build-up. Another potential problem is a build up of heat from poor heat dissipation of the inner conductor because there are no conduction paths that are inherent with "directly" contacting conductors.

In an attempt to overcome these problems, a thermal shunt, or other thermally conductive path consisting of a direct electrical and thermally conductive path between the inner conductor and the outer conductor has been added to the interface. This requires that the inner conductor of the PIM sensitive hardware must be intimately attached to the outer conductor. At least one fastening attachment, such as a screw, is normally used. Unfortunately, this assembly is not very reliable in terms of PIM avoidance.

There is a need for a PIM sensitive diplexing-filter common interface that provides PIM reliability in conjunction with ESD conduction and thermal dissipation, making it ideal for high power space applications.

SUMMARY OF THE INVENTION

The present invention is a one-piece interface connector for a PIM sensitive diplexing filter. In the present invention there is an absence of contacting connections of the inner-conductor. The inner-conductor and outer-conductor are one piece, thereby eliminating any direct metal-to-metal connections to the high current carrying inner-conductor. The only direct connection is to the outer-conductor that can be connected by any means proven to have high reliability in the avoidance of PIM generation, such as a high-pressure connection.

The present invention allows the transfer of high power RF energy from the resonating element of a cavity resonating filter to another component, such as an antenna feed element. The transfer is such that it avoids the risk of PIM generation while providing a thermally conductive path and an electrostatic conductive path to dissipate heat and dissipate static electric charges from the transmission line inner conductor.

The inner-conductor of the interface is integral with the outer-conductor of the interface, thereby eliminating any need to connect the inner-conductors of the interface to the outer conductor. The outer-conductor of the interface has flange, or other structure, which allows for a connection to the outer-conductor of a transmission line or filter housing. The result is a "one-piece" construction of a diplexed, (or multiplexed), coaxial, (or squareax), transmission line so as to provide a direct path for thermal dissipation and ESD ground and having a non-contacting, integral inner-conductor interface.

It is an object of the present invention to transfer high power RF energy from a resonating filter to another component. It is another object of the present invention to avoid the risk of passive intermodulation generation. It is yet another object of the present invention to provide a conductive path to dissipate heat and static electric charges.

Other objects and features of the present invention will become apparent when viewed in light of the detailed description of the preferred embodiment when taken in conjunction with the attached drawings and appended claims.

BRIEF DESCRIPTION OF THE DRAWINGS

In order that the invention may be well understood, there will now be described some embodiments thereof, given by way of example, reference being made to the accompanying drawings, in which.

BEST MODE(S) FOR CARRYING OUT THE INVENTION

Figure 1:
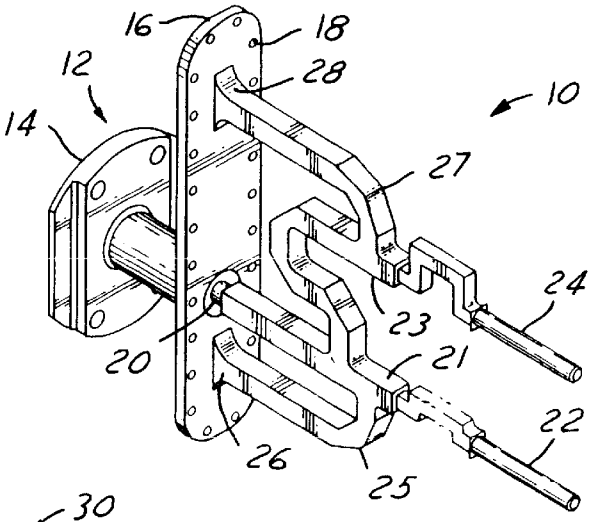
FIG. 1 is a perspective view of a coaxial diplexer interface of the present invention.

FIG. 1 is a perspective view of the low passive intermodulation (PIM) coaxial diplexer interface 10 of the present invention. It should be noted that while the present invention is being described herein in conjunction with a diplexed coaxial transmission line, it is possible to incorporate the present invention with a multiplexed coaxial or squareax transmission line as well. One of ordinary skill in the art will have knowledge sufficient, in conjunction with the information in the present disclosure, to apply the present invention to the multiplexed coaxial or squareax transmission line application.

An outer conductor 12 of the interface 10 has a common port 14 and a flange member 16 having structure 18 for receiving a high-pressure interface (not shown). Integral to the outer conductor 12 is an inner conductor 20.

The inner conductor 20 has several branches 21, 23, 25 and 27, leading to terminations of the inner conductor 20. The first branch 21 leads to a non-contacting coupling with a resonating element of a section of a PIM sensitive device (not shown) by way of a quarter wavelength coupling probe 22. Branch 23 leads to a non-contacting coupling with a resonating element of another section of the PIM sensitive device (not shown) by way of probe 24.

Branches 25 and 27 lead to terminations 26 and 28 at the flange 16 making the inner conductor 20 and the outer conductor 12 an integral piece. The terminations 26 and 28 provide the necessary isolation and at the same time provide the electrical and thermal conduction required for PIM reliability.

Because the terminations 26 and 28 are integral to the flange member 16, it is possible to manufacture the inner and outer conductors as one integral part, as for example, by a machining process. The terminations 26 and 28 provide a direct thermal dissipative path and ESD ground. The branches 21 and 23 provide a connectionless interface with a PIM sensitive device (not shown).

Figure 2:
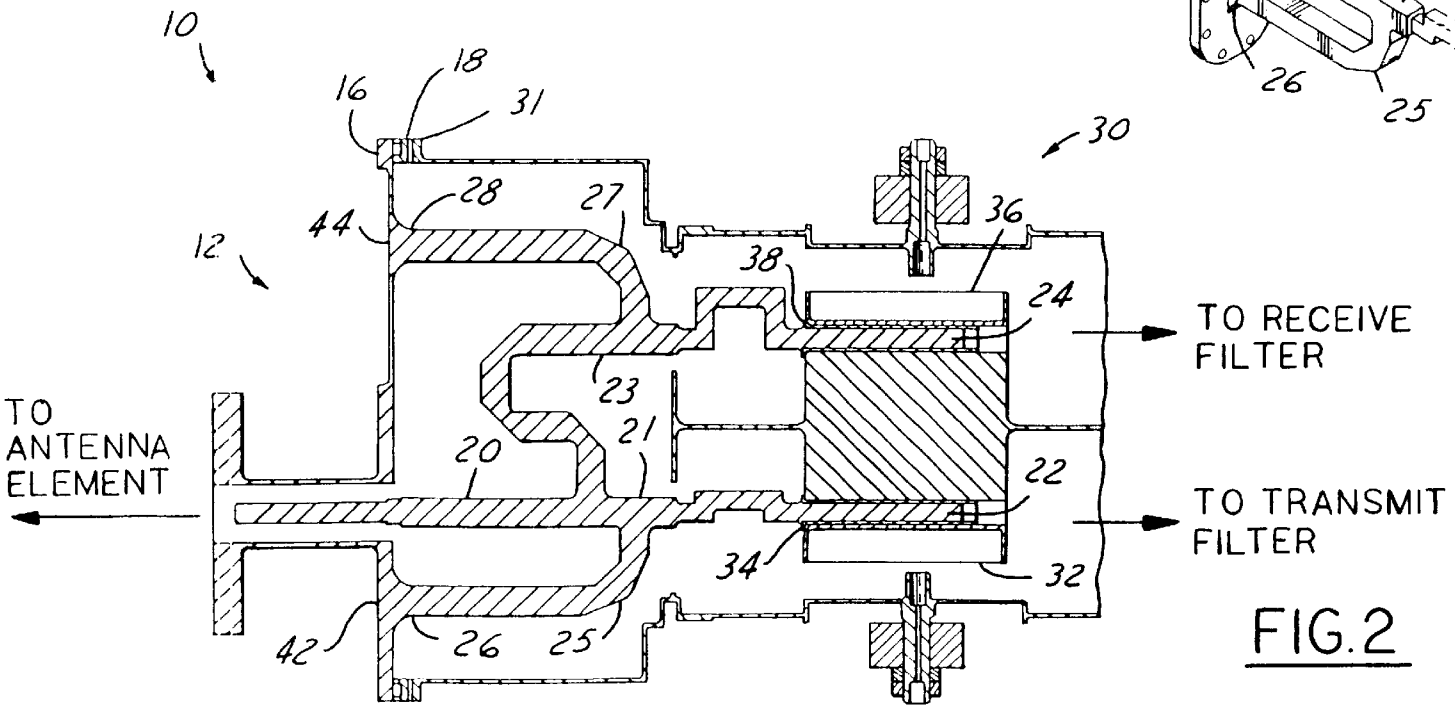
FIG. 2 is a cross-sectional view of the coaxial diplexer interface of the present invention in communication with a filter housing.

FIG. 2 is a cross-sectional view of the interface 10 of the present invention in communication with a PIM sensitive filter 30. Only non-contacting connections are present at the inner conductor branches 21 and 23 by way of probes 22, 24.

The only direct connection is provided at the outer conductor 12 of the interface 10 where it is connected at the flange 16 with a high pressure fitting 31. It is known that a high-pressure interface of 10 kPSI provides a reliable PIM avoidance connection, a good thermal conduction path, and a good ESD conduction path. It is possible, however, to substitute the high pressure interface shown with another suitable connection method.

The various connections of the interface 10 are connected to the filter 30 in the following manner. A first resonating element 32 of the transmit filter section is coupled to probe 22 by way of a non-contacting choke joint. In a choke joint, the surface of the connection is covered with a dielectric material 34 to isolate the connection, making it non-contacting. The first resonating element 36 of the receive filter section is also coupled to the inner conductor 20 by the second probe 24, also by way of a choke joint isolated by dielectric material 38. The first and second probes 24, 22 maintain a length, or phase, relationship such that the transmit and receive filter sections are multiplexed at a termination 40 of the inner conductor 20. The termination 40 is coupled to an antenna element, (not shown), also by a choke joint.

The terminations 26 and 28 of the inner conductor 20 are directly integrated to the outer conductor 12 in a one-piece construction as described above. The terminations 26 and 28 maintain a length, or phase, relationship such that an "open" circuit appears respectively at transmit and receive bands, yet maintains a short circuit for thermal conduction from the inner conductor 20 and ESD conduction to the outer conductor 12.

Using a high-pressure interface 31, the outer conductor of the filter housing 30 is directly connected to the outer conductor of the coaxial diplexer interface 12, yet the inner conductor 20 is connectionless, thereby avoiding the generation of any PIM through direct connections.

While particular embodiments of the invention have been shown and described, numerous variations and alternate embodiments will occur to those skilled in the art. Accordingly, it is intended that the invention be limited only in terms of the appended claims.

What is claimed is:

1. An interface for a PIM sensitive device, said interface comprising:

a one-piece integrated configuration for inner and outer conductors, said one-piece configuration having predefined paths for providing direct electrical and thermal conduction therebetween.

2. The interface as claimed in claim 1 further comprising a flange for connection to said PIM sensitive device.

3. The interface as claimed in claim 2 wherein said flange further comprises fastening members for a high-pressure interface.

4. The interface as claimed in claim 2 wherein said inner conductor branches into a plurality of terminations, at least one of which connects to said outer conductor at said flange member.

5. The interface as claimed in claim 1 wherein said inner conductor and said PIM sensitive device are connected by at least one non-contacting choke joint.

6. The interface as claimed in claim 4 wherein said inner conductor further comprises at least one branch from said inner conductor to said flange member such that a short circuit is provided for thermal and ESD conduction.

7. An interface for a PIM sensitive device, said interface comprising:

a one-piece integrated configuration for inner and outer conductors, said one piece configuration having predefined paths for providing electrical and thermal conduction therebetween;

a flange for connection to said PIM sensitive device;

wherein said inner conductor branches into a plurality of terminations, at least one of which connects to said outer conductor at said flange member; and wherein said inner conductor further comprises at least one branch from said inner conductor away from said flange member to provide an open circuit to said PIM sensitive device.

8. The interface as claimed in claim 7 wherein said at least one branch further comprises a branch for a transmit band and a branch for a receive band.

9. The interface as claimed in claim 7 wherein said at least one branch extending away from said outer conductor is coupled to said PIM sensitive device by way of a choke joint.

10. The interface as claimed in claim 7 and further comprising at least one branch for coupling to a transmit filter section and at least one branch for coupling to a receive filter section.

11. The interface as claimed in claim 10 wherein said couplings are non-contacting choke joints.

* * * * *